US005500985A

United States Patent [19]

Klueger

[11] Patent Number: 5,500,985

[45] Date of Patent: Mar. 26, 1996

[54] VEHICLE HINGE ASSEMBLY WITH TRANSLATING PIVOT

[75] Inventor: Herbert D. Klueger, Farmington Hills, Mich.

[73] Assignee: Chrysler Corporation, Highland Park, Mich.

[21] Appl. No.: 407,355

[22] Filed: Mar. 20, 1995

[51] Int. Cl.[6] ..... E05D 7/00; E05D 11/06

[52] U.S. Cl. ..... 16/354; 16/355; 16/357; 16/359; 16/361; 16/369

[58] Field of Search ..... 16/354, 355, 356, 16/357, 358, 359, 360, 361, 368, 369

[56] References Cited

U.S. PATENT DOCUMENTS

| | | | |
|---|---|---|---|
| 465,112 | 12/1891 | Kearsing . | |
| 1,998,319 | 4/1935 | Johnson . | |
| 2,668,320 | 2/1954 | Lustig . | |
| 2,890,476 | 6/1959 | Lustig . | |
| 4,411,046 | 10/1983 | Nawrath . | |
| 4,584,738 | 4/1986 | Lautenschläger . | |
| 4,979,265 | 12/1990 | Grass . | |
| 5,050,270 | 9/1991 | Burgei et al. | 16/361 |
| 5,102,084 | 4/1992 | Park . | |
| 5,195,796 | 3/1993 | Wampler, II . | |

*Primary Examiner*—Maurina T. Rachuba
*Assistant Examiner*—Adesh Bhargava
*Attorney, Agent, or Firm*—Thomas G. Pasternak

[57] ABSTRACT

A hinge assembly for mounting to a vehicle body a rear deck movable closure panel, wherein as the panel is opened its forward edge is shifted rearward away from adjacent body structure. The hinge assembly includes a forward sector gear fixed to a panel-half hinge member and an aft sector gear pivoted to a body-half hinge member wherein the sector gears are disposed between a pair of angled link members. The body-half hinge member includes inboard and outboard opposed wall surfaces having upper and lower pairs of aligned horizontal guide slots. The aft sector gear and pair of links are supported between the wall surfaces with the aft sector gear meshed with the forward sector gear and a subjacent gear rack. The links tie a forward sector gear pivot pin to an intermediate pivot pin slidably received in the upper pair of guide slots and an aft pivot pin slidably received in the lower pair of guide slots. As the panel and forward sector gear rotate counter-clockwise to the panel open position, the aft sector gear rotates clockwise while conjointly traveling rearward on the gear rack together with the forward pivot pin, about which the panel is rotating. Thus, as the panel moves from its closed position to its full open position, the panel forward edge clears the vehicle body.

11 Claims, 3 Drawing Sheets

VEHICLE HINGE ASSEMBLY WITH TRANSLATING PIVOT

BACKGROUND OF THE INVENTION

This invention relates to vehicle body hinge assemblies for a closure panel and more particularly to a hinge assembly with a translating pivot axis which eliminates interference of the closure panel forward edge relative to an adjacent portion of the body structure.

The automotive industry has developed various vehicle closure hinge assemblies wherein the opening movement of the closure panel will shift the edge of the closure panel rearwardly during closing. The U.S. Pat. No. 5,195,796 issued Mar. 23, 1993 to Wampler, II discloses a "goose-neck" type hinge assembly for mounting a deck lid closure with an leading edge that shifts away from the body rear window structure. The Wampler patent involves a hinge assembly bracket mounted to the body structure and projecting under the leading edge of the closure with a pair of plates each having a guide slot. A goose-neck hinge strap is interposed between the two plates of the bracket and has an end secured to the closure panel near the leading edge. A first guide roller is carried by the other end of the strap and is slidably received by one of the guide slots.

The U.S. Pat. No. 5,102,084 issued Apr. 7, 1992 to Park is entitled "Positioning Apparatus With Gears And a Pivot For Angularly And Longitudinally Positioning The Screen of a Lap Top Computer". In the Park patent a pair of racks are longitudinally fixed to the rear wall of a housing and a mating pair of pinions are fixedly mounted on pinion shafts. Driving gears are fixedly mounted on the hinge shafts for rotating the pinion in the same direction through idle gears and transmission gears.

The U.S. Pat. No. 4,411,046 issued Oct. 25, 1983 to Nawrath and entitled "Multi-Pintle Hinge With Rack and Pinion Slide", discloses a hinge for opening a door up to an angle of about 180 degrees. The Nawrath hinge includes a mounting plate and a hinge casing connected by two hinge arms wherein the movement of the hinge arms with respect to each other is controlled by a rack and pinion arrangement. One hinge arm carries the pinion and this hinge arm is guided at two points of connection in guiding grooves in the mounting plate.

Further examples of hinge assemblies incorporating gear arrangements are found in the following patents; U.S. Pat. Nos. 4,979,265 issued Dec. 25, 1990 to Grass, 2,668,320 issued Feb. 9, 1954 to Lustig, 1,998,319 issued Apr. 16, 1935 to Johnson, and 465,112 issued Dec. 15, 1891 to Kearsing.

SUMMARY OF THE INVENTION

It is a feature of the present invention to provide a translating pivot for a vehicle closure panel hinge assembly incorporating a pair of sector gears and a gear rack for controlling the movement of the closure panel pivot axis such that a closure panel edge is shifted away from adjacent body structure as the panel moves from the closed position to the open position.

It is another feature of the present invention to provide a translating pivot hinge assembly as set forth above wherein, as the closure panel rotates counter-clockwise to the open position, it rotates a first sector gear fixed on the panel-half hinge strap. The first sector gear has a plurality of teeth in meshed engagement with a plurality of teeth of a second sector gear pivotally mounted on a body-half hinge frame causing the second gear to rotate clockwise. The second gear has a plurality of teeth in meshed engagement with a plurality of teeth of a subjacent longitudinally extending gear rack supported on the frame while link members pivotally interconnect the sector gears to the frame. The body-half hinge frame comprises a pair of inboard and outboard mirror image plates formed with upper and lower horizontally disposed pairs of aligned guide slots. The upper pair of slots extend rearwardly from the plate leading edges while the lower pair of slots extend forwardly from the plate trailing edges. The plates provide laterally spaced respective inboard and outboard wall surfaces with each surface in flush sliding contact with one of a pair of identical dogleg-shaped links disposed opposite each other.

The links each have a forwardly extending leg portion terminating in a forward pivot hole, a downwardly and rearwardly angled leg portion terminating in an aft pivot hole and an intermediate pivot hole at the juncture of its leg portions. A forward pivot pin extends through each link forward pivot hole and a center of rotation hole of the first sector gear while an intermediate pivot pin extends through the upper guide slots, the link intermediate pivot holes and a center of rotation hole of the second sector gear. An aft pivot pin extends through the lower guide slots and the link aft pivot holes. In the panel closed position the link forwardly extending leg portions project a predetermined length beyond the leading edges of the frame plates by virtue of the intermediate pivot pin being positioned at the forward end of the upper guide slots and the aft pivot pin being positioned at the forward end of the lower guide slots.

With the closure panel in its closed position, as the closure panel and forward sector gear are rotated counter-clockwise about the forward pivot pin to the panel open position, the aft sector gear rotates clockwise. During the panel opening movement the oppositely rotating sector gears conjointly travel rearward, by virtue of the aft sector gear being meshed with the gear rack, resulting in rearward translation of the forward pivot pin. Thus, as the panel swings to its full open position, the panel forward edge shifts away from the vehicle body structure.

An advantage of the translating pivot hinge assembly of the present invention is that it provides improved packaging and structural integrity for torsion and lateral displacement in comparison to most goose-neck type hinge assemblies. Still another advantage of applicants hinge assembly is that various combinations of gear ratios, sizes and orientations may be used to achieve a desired closure panel motion readily tailored for a particular vehicle.

BRIEF DESCRIPTION OF THE DRAWINGS

These and other objects, features and advantages of the invention will appear from the following written description and the accompanying drawings in which.

DETAILED DESCRIPTION OF THE INVENTION

Figure 1:
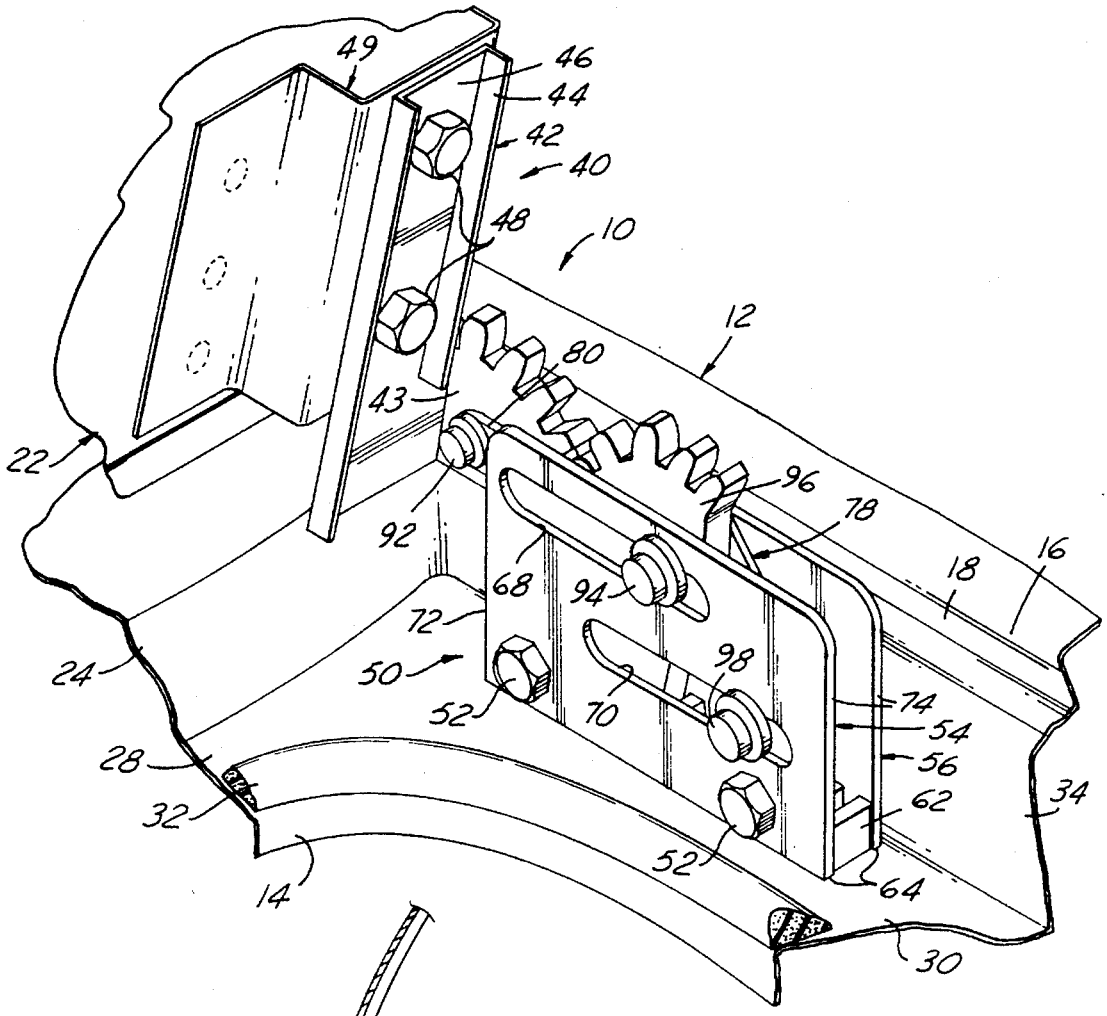
FIG. 1 is a fragmentary perspective view of a vehicle showing a hinge assembly of the present invention pivotally supporting a deck closure in its raised position.

Referring now to the drawings and in particular to FIG. 1, an automotive vehicle 10 has a body structure 12 with a luggage compartment or trunk 14. An opening 16 allows access to the trunk 14 and is bordered by a pair of side flanges 18 and a forward flange 20. A closure panel or deck lid 22, covers the opening 16 when the panel is in a closed position shown in FIG. 5. A pair of side quarter fender panels (not shown) a transverse body structure 24 define an opening for a rear window 26. A transversely extending inner shelf flange 28 and side shelf flanges define the rear trunk compartment opening 14 provided with a circumferentially extending seal 32.

FIG. 1 shows the closure panel 22 swingably mounted to the inner shelf upstanding flange 34 by means of a pair of right and left hinge assemblies with only the right hinge assembly being depicted generally at 40. The hinge assemblies 40 allow the closure panel 22 to swing between a full open position of FIG. 2 and a closed position in which the panel closes off access to the rear compartment 14 and engages the seal 32. The panel 22 is adapted to be latched in its closed position by a suitable latch mechanism (not shown) when the panel is moved to its closed position. As the hinge assemblies are identical except as to hand, i.e. mirror images of each other, only the right hand assembly 40 will be described.

Figure 6:
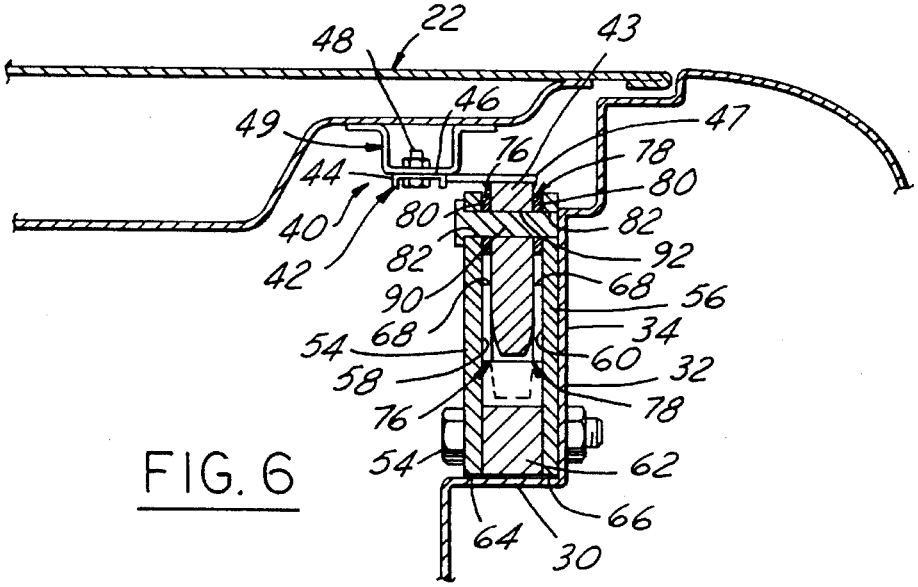
FIG. 6 is a fragmentary vertical sectional view taken on the line 6—6 of FIG. 5.

As seen in FIG. 1 the translating pivot hinge assembly 40 includes a panel-half hinge member comprising longitudinally extending channel shaped strap 42 fixedly supporting a substantially 90 degree forward gear segment 43. The strap 42 has side flanges 44, a bight wall 46 and a outboard extending mounting plate 47 (FIG. 6). The strap 42 is shown secured by a pair of bolts 48 to inner panel bracket 49 on an underside of the closure 22. As seen in FIG. 6 the forward gear segment 43 is suitably secured to the extension plate 47 as by welding.

Figure 3:
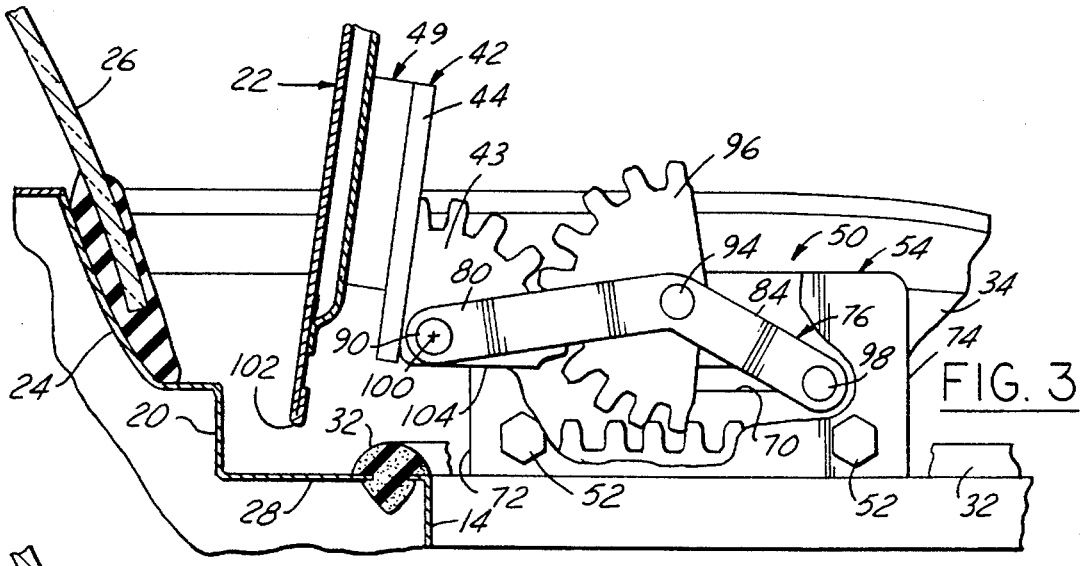
FIG. 3 is a view similar to FIG. 2 with the body-half hinge frame partially broken away showing details of the meshed sector gears, the gear rack an angled link interconnecting the sector gears with the hinge frame.

With reference to FIGS. 1 and 3 a longitudinally extending body-half hinge frame, generally indicated at 50, is adapted to be suitably secured to the body upstanding flange 32 as by the pair of bolts 52. The body-half hinge frame 50 comprises inboard 54 and outboard 56 generally rectangular mirror image plate members providing associated laterally spaced inboard 58 and outboard 60 opposed parallel wall surfaces having a predetermined distance therebetween. A longitudinally extending gear rack 62 is shown in FIG. 6 sandwiched between the wall surfaces 58 and 60 along lower side edges 64—64 of the plate members 54 and 56, respectively. It will be noted that the gear rack 62, shown secured to the plate members 54 an 56 by the mounting bolts 52, provides a spacer maintaining the wall surfaces 58 and 60 at their predetermined spaced distance.

Figure 2:
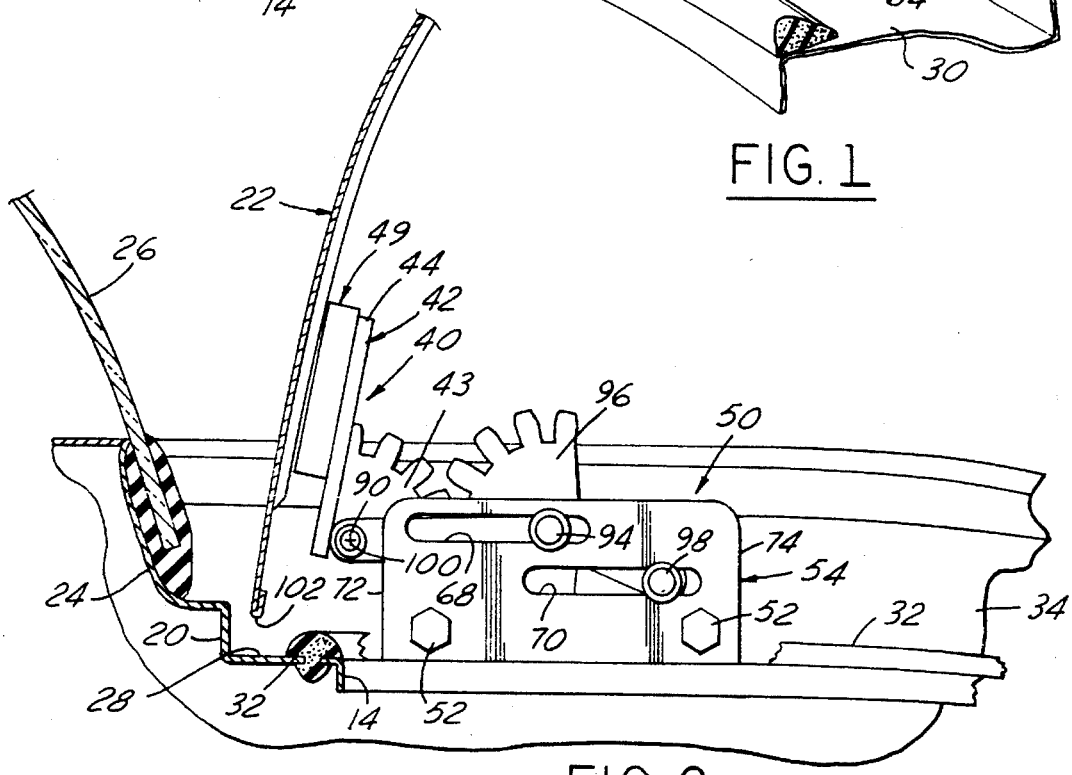
FIG. 2 is an enlarged fragmentary side view of the of the hinge assembly of FIG. 1.

FIGS. 2 and 6 show the inboard plate member 54 provided with upper 68—68 and lower 70—70 aligned pairs of elongated horizontally disposed guide slots. The upper pair of guide slots 68 are shown extending rearwardly from associated forward edges 72 while the lower pair of guide slots 70 are shown extending forwardly from associated aft edges 74.

Referring to FIGS. 3 and 6 a pair of identical inboard 76 and outboard 78 obtuse angled links are shown in flush sliding contact with their associated inboard 58 and outboard 60 wall surfaces. As seen with inboard link 76 in FIGS. 3 and 8, each link is defined a forwardly extending leg portion 80 terminating in a forward pivot hole 82, and a downwardly and rearwardly extending angled leg portion 84 terminating in an aft pivot hole 86. Each link is also provided with an intermediate pivot hole 88 at the juncture of the link forward leg portion 80 and angled leg portion 84. With reference to FIG. 6 it will be seen that the forward sector gear 43 is sandwiched between the forward leg portions 80 with a forward pivot journal pin 90 extending through the forward link holes 82 and a center of rotation hole 92 of the forward sector gear 43.

With the closure panel 22 in its open position of FIG. 3 an intermediate pivot pin 94 extends through the forward end of each upper guide slot 68, each link intermediate pivot hole 88 and a center of rotation hole (not shown) of a substantially 180 degree aft sector gear 96. An aft pivot pin 98 extends through the forward end of each lower guide slot 70 and each link angled leg aft pivot hole 86.

Figure 4:
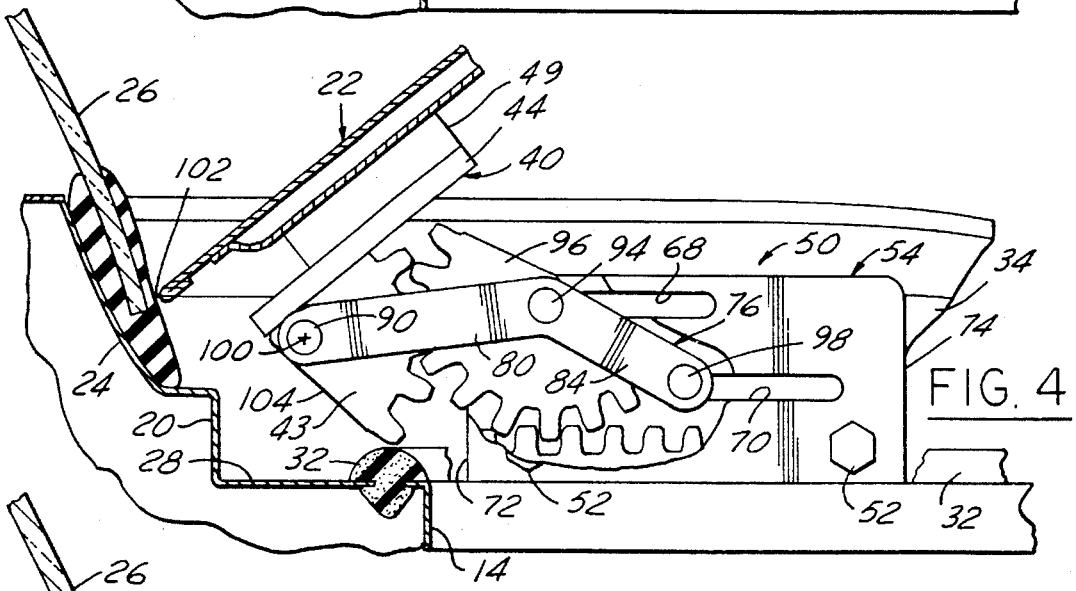
FIG. 4 is a view similar to FIG. 3 showing the deck closure in a partially closed position.
Figure 5:
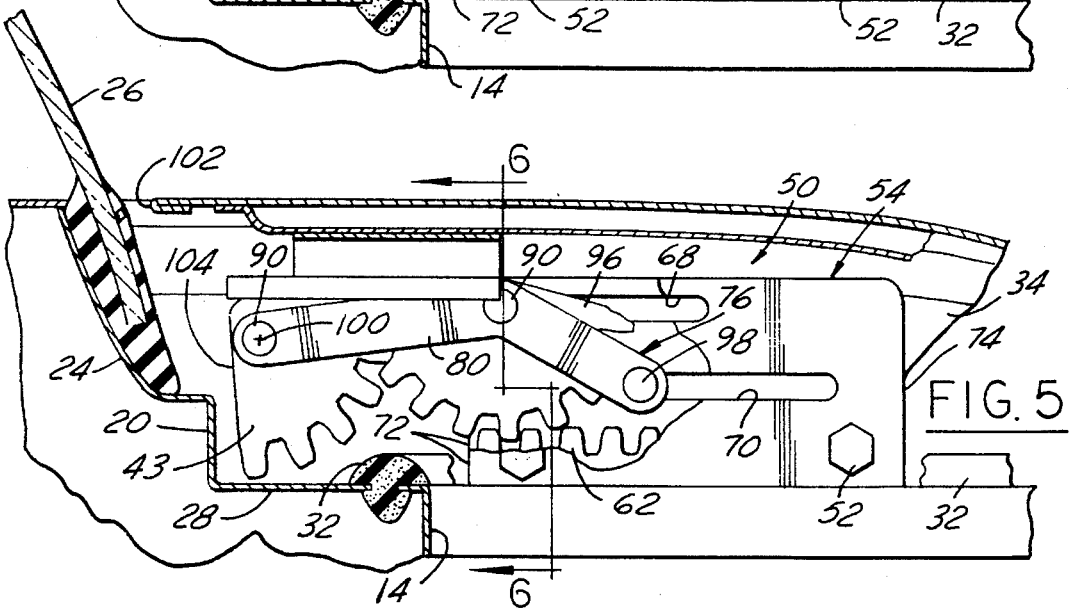
FIG. 5 is a view similar to FIG. 3 showing the deck closure in its closed position.

Referring to FIG. 5, wherein the panel 22 is shown in its closed position, as the panel is rotated counter-clockwise about the translating axis of the forward pivot pin 90 to its open position the aft sector gear 96 is rotated clockwise about the intermediate pivot pin 94 causing the aft sector gear 96 to travel rearwardly on the gear rack 62. It will be observed that simultaneously with the panel opening movement the oppositely rotating sector gears 43 and 96 conjointly travel rearward together with the links 76. Such rearward travel of the links 76 results in the hinge assembly instantaneous center, defined by the forward pivot pin principal transverse axis 100, translating rearwardly thereby, shifting panel forward transverse edge 102 away from the vehicle body structure, as seen in FIGS. 3 and 4.

It will be noted in FIG. 5 that with the panel in its closed position the hinge assembly instantaneous center 100 is adjacent the forward flange 20 while in the panel full open position of FIG. 3 the instantaneous center 100 is slightly aft of the trunk wall 14. Further, with the panel closed, the forward 90 degree sector gear has its one substantially vertical edge 104 positioned adjacent the trunk forward vertical flange 20 thereby minimizing the required packaging space for the hinge assembly.

Figure 7:
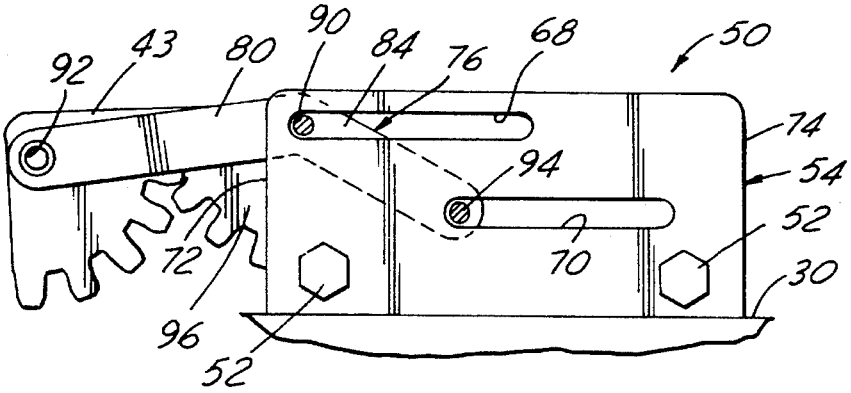
FIG. 7 is a side view of the hinge assembly with portions removed showing details of the pivotal connections.
Figure 8:
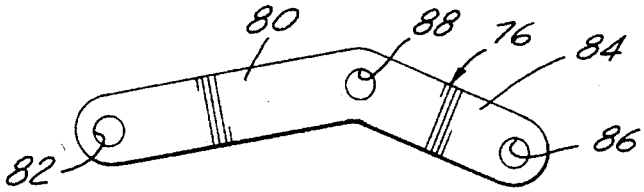
FIG. 8 is a detail view of one of the angle links.

With reference to FIG. 7 it will be seen that the pins 90 and 94 have a predetermined diameter for journaled reception in their associated guide slots 68 and 70. Further the forward end of in board link portion 80 is broken away to show the center of pivot 92 of the gear segment 43. FIG. 8 shows pivot holes 82, 86 and 88 of a predetermined diameter for journaled reception of their associated pivot pins 90, 94, and 98.

Although the present invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims:

What is claimed is:

1. A hinge assembly for mounting a closure panel with an edge on a vehicle body structure for movement between an upwardly extending panel open position and a panel closed position, said hinge assembly comprising:

a panel-half hinge member adapted to be secured to the panel adjacent a forward edge thereof, a longitudinally extending vertically disposed forward sector gear adapted to be fixedly connected to the panel-half hinge member;

a longitudinally extending body-half hinge member adapted to be secured to a body portion, said body-half hinge member defining laterally spaced inboard and outboard opposed wall surfaces with a predetermined distance therebetween supporting a longitudinally extending gear rack adjacent a lower portion said member;

said wall surfaces having an upper pair of elongated horizontal guide slots and a lower pair of elongated horizontal guide slots;

a pair of inboard and outboard links, said forward sector gear and an aft sector gear being in meshed relation and positioned between said links and with said aft sector gear in meshed relation with said gear rack;

each said link defined by a forward extending leg portion terminating in a forward pivot hole, a downwardly and rearwardly angled leg portion terminating in an aft pivot hole and an intermediate pivot hole at a juncture of said leg portions, a forward pivot pin extending thorough said forward link holes and a center of rotation hole of said forward sector gear;

an intermediate pivot pin extending through each upper slot, each link intermediate hole and a center of rotation hole of said aft sector gear, and an aft pivot pin extending through each lower guide slot and each said link aft hole; whereby as the panel and forward sector gear are rotated counter-clockwise about said forward pivot pin to the panel open position said aft sector gear rotates clockwise about said intermediate pivot pin while said aft sector gear conjointly travels rearward on said gear rack, causing said links to translate said forward pivot pin rearward thereby shifting the panel edge away from the body structure.

2. The hinge assembly as set forth in claim 1 wherein said forward sector gear defining an arc of substantially 90 degrees.

3. The hinge assembly as set forth in claim 1 wherein and said aft sector gear defining and arc of substantially 180 degrees.

4. The hinge assembly as set forth in claim 1 wherein said gear rack side surfaces in flush sandwiched relation with their associated inboard and outboard wall surfaces.

5. The hinge assembly as set forth in claim 1 wherein with the panel in its closed position said intermediate pivot pin and said aft pivot pin positioned adjacent a forward end of their associated guide slots, and with the panel in its full open position said intermediate pivot pin and said aft pivot pin positioned adjacent the aft ends of their associated guide slots.

6. The hinge assembly as set forth in claim 1 wherein each said link in flush sliding contact with an associated wall surface.

7. The hinge assembly as set forth in claim 1 wherein said body-half hinge member in the form of a frame comprising a pair of inboard and outboard mirror image plate members providing said opposed wall surfaces, said frame supporting said gear rack adjacent a lower portion of said frame members.

8. The hinge assembly as set forth in claim 1 wherein said plate members being generally rectangular defining forward and aft vertical edges, and said forward pivot pin providing a panel full open stop upon being translated rearwardly into contact with said forward plate member edges.

9. The hinge assembly as set forth in claim 1 wherein with an outboard plate member adapted for flush engagement with a vertically disposed body panel.

10. The hinge assembly as set forth in claim 1 wherein each said angled link defines an obtuse angle of the order of 145 degrees.

11. The hinge assembly as set forth in claim 1 wherein said upper and lower guide slots of equal length, and wherein an aft portion of each said upper guide slot overlaps by a predetermined dimension a forward portion of each said lower guide slot.

* * * * *